US005231375A

United States Patent [19]

Sanders et al.

[11] Patent Number: 5,231,375

[45] Date of Patent: Jul. 27, 1993

[54] APPARATUS AND METHOD FOR DETECTING THEFT OF ELECTRONIC EQUIPMENT

[75] Inventors: Kirk D. Sanders, Sunnyvale; Bruce H. Edwards, Santa Clara; George A. Rasko; Wayne D. Torrey, both of San Jose, all of Calif.; Kevin P. Goffinet, Lexington, Ky.

[73] Assignee: Rolm Company, Santa Clara, Calif.

[21] Appl. No.: 712,027

[22] Filed: Jun. 7, 1991

[51] Int. Cl.[5] ..... G08B 13/14

[52] U.S. Cl. ..... 340/568; 340/529; 340/664; 340/687

[58] Field of Search ..... 340/568, 571, 664, 663, 340/687, 529-530, 652, 693; 307/131; 439/489, 917

[56] References Cited

U.S. PATENT DOCUMENTS

| | | | |
|---|---|---|---|
| 4,736,195 | 4/1988 | McMurtry et al. | 340/568 |
| 4,760,382 | 7/1988 | Faulkner | 340/568 X |
| 4,896,140 | 1/1990 | Biever et al. | 340/568 |
| 4,952,912 | 8/1990 | Tanaka | 340/568 |
| 4,973,945 | 11/1990 | St. John | 340/571 |

*Primary Examiner*—Thomas Mullen
*Attorney, Agent, or Firm*—Michael B. Einschlag

[57] ABSTRACT

A system is disclosed for deterring theft of portable electronic equipment that operates in accordance with an industry standard known as EIA-232-D. A theft deterrent unit monitors signal current transmitted between interconnected electronic units. When one or more of the interconnected electronic units is disconnected, the theft deterrent unit detects the cessation of signal current and activates an alarm. The alarm may be used to generate a local alarm such as, for example, an audible alarm, and the alarm signal may be transmitted to a central alarm system for further processing.

16 Claims, 4 Drawing Sheets

APPARATUS AND METHOD FOR DETECTING THEFT OF ELECTRONIC EQUIPMENT

TECHNICAL FIELD OF THE INVENTION

The present invention relates to theft detection systems for electronic equipment and, more particularly, to theft detection systems for electronic equipment that transmits and receives signals through cable connections.

BACKGROUND OF THE INVENTION

Electronic and communication equipment is often a target for theft. Items of electronic equipment such as computers, laser printers and fax machines have high economic value and are portable enough to invite theft. Various security systems have been used in the prior art to deter such theft. For example, electronic units have been bolted onto heavy objects, and locking cables or chains have been used to join multiple units of computer systems together. These mechanical theft protection schemes often provide less than a satisfactory solution to the theft problem. Many users of this electronic equipment are discouraged from using these mechanical protection mechanisms because they detract from the portability of the equipment.

Furthermore, many manufacturers of electronic units develop and market their products to appeal to office workers who wish to begin operating the units immediately without the use of special tools or assembly equipment. In other words, it is desirable for a purchaser to be able to remove the components of an electronic unit such as a computer from its packaging, plug some electronic and power supply cables together, and start using the computer immediately. It is inconvenient and burdensome to drill holes in desks and benches and install bolts and cables. Because of the inconvenience of installing mechanical theft deterrent systems, these systems are often not installed and electronic units remain vulnerable to theft.

Current carrying conductors are used in theft detection systems. Such systems typically use metallic foil tapes as current carrying conductors. The tapes are placed on surfaces of objects that are likely to be broken or displaced if a theft occurs. For example, a tape may be adhered to a glass window or some valuable object. In these systems it is necessary to perform a complex installation procedure. If it is desired to move an object after a tape is applied to it, the complex installation procedure must be repeated. Additionally, these theft detection systems typically require that special wiring must be installed between the conductive tapes and some remote source of power and alarm unit. Because of these characteristics, these systems have not been applied to the detection of theft of portable electronic equipment. It is not practical to install conductive tapes onto the electronic units. If such an installation were made, a routine act such as sliding an electronic unit from one side of a desk to another side might generate a false alarm signal. Additionally, the fragile conductive tapes of the prior art would be subject to repeated damage from normal office activity with resulting false alarms.

It is therefore desirable to provide a convenient and easy to install theft detection system for electronic units which does not adversely effect the portability of the units.

SUMMARY OF THE INVENTION

Embodiments of the present invention are theft detection systems for use in connection with electronic units which comprise a theft detection circuit and an alarm signaling system. In one such embodiment, the theft detection circuit and an alarm signaling device are assembled in a theft detection unit which is connectable with standard interconnection cables and connectors to the electronic unit to be protected. For example, the cables and connectors used to connect the theft detection unit with the electronic units are compatible with industry standard cables and connectors that are regularly used to interconnect the electronic units. In use, the theft detection unit continuously monitors signal current that passes between two or more interconnected electronic units and an alarm signal is produced whenever a sustained interruption of signal current is sensed. The alarm signal may be used to generate a local alarm such as, for example, an audible alarm, and the alarm signal may be transmitted to a central alarm system for further processing.

Viewed from one aspect, the present invention is directed to method and apparatus for detecting theft of an electronic unit which regularly sends or receives signal current. The apparatus comprises means for sensing interruptions of the signal current being transmitted to or from the electronic unit and means for producing an alarm signal whenever the signal current is interrupted for a period of time greater than the time associated with normal signal-produced interruptions.

BRIEF DESCRIPTION OF THE DRAWING

A complete understanding of the present invention may be gained by considering the following detailed description in conjunction with the accompanying drawing, in which.

DETAILED DESCRIPTION

Figure 1:
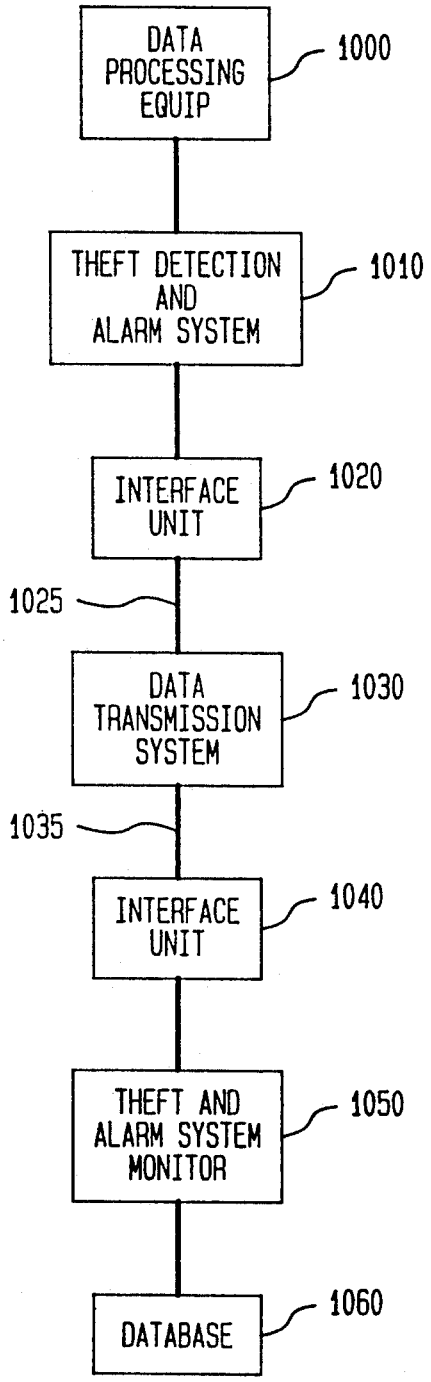
FIG. 1 shows a block diagram of an embodiment of the present invention which illustrates its use in detecting theft of equipment.

FIG. 1 shows a block diagram of an embodiment of the present invention which illustrates its use in detecting theft of equipment such as data processing equipment 1000. As shown in FIG. 1, data processing equipment 1000 is connected to theft detection and alarm system 1010 and theft detection and alarm system 1010 is connected, in turn, to interface unit 1020. Interface unit 1020 is connected to data transmission system 1030 and data transmission system 1030 is connected, in turn, interface unit 1040. Finally, interface unit 1040 is connected to theft and alarm system monitor 1050. In accordance with the present invention, an embodiment of the present invention detects the theft of equipment such as data processing equipment 1000 where data processing equipment 1000 is any one of a number of different types of data processing equipment or electronic equipment which are commercially available such as, for example, an IBM TM PS/2 TM personal computer. Specific embodiments of theft detection and alarm system 1010 which are fabricated in accordance with the present invention will be discussed in detail below, however, in a preferred embodiment of the present invention: (a) interface unit 1020 and interface unit 1040 are each a data communication module ("DCM") produced by ROLM Systems of Santa Clara, Calif.; (b) data transmission system 1030 is a ROLM TM Systems Computerized Business Exchange (CBX) which is manufactured by ROLM Systems of Santa Clara, Calif.; and (c) theft and alarm system monitor 1050 is a data analysis system such as an IBM PS/2 personal computer and an associated database, which database may be database 1060 which is local to the personal computer or it may be a centralized database (not shown) which is accessible from the personal computer.

Specifically, CBX 1030 is a voice and data switching apparatus. Data may be transmitted between two data transmission apparatus by utilizing the data switching capability of CBX 1030. This is accomplished by first interfacing each of the two data transmission apparatus with a DCM—for example, in a preferred embodiment of the present invention, interface unit 1020 of FIG. 1 is a DCM and interface unit 1040 of FIG. 1 is a DCM. Then, each of the DCM's, i.e., DCM 1020 and DCM 1040 of FIG. 1 is interfaced to CBX 1030. DCM 1020 and DCM 1040 provide an interface between an RS-232 serial data transmission format to a specific data transmission format which is used by CBX 1030. Asynchronous data applications on CBX 1030 are based on an asynchronous EIA-232-D industry standard which is promulgated by the Electronic Industries Association (EIA). This standard is also designated by the title "Interface Between Data Terminal Equipment and Data Circuit—Terminating Equipment Employing Serial Binary Data Interchange."

In accordance with a preferred embodiment of the present invention, DCM 1020 is connected to CBX 1030 at all times and, in accordance with a standard ROLM Systems DCM-CBX interface requirement, status/configuration information is transferred between DCM 1020 and CBX 1030 at all times. The exchange of the standard DCM-CBX status/configuration information operates concurrently with the transmission of data between DCM 1020 and CBX 1030.

DCM 1020 and DCM 1040 interface with CBX 1030 over two-wire digital links 1025 and 1035, respectively, which are ROLMLink TM two-wire digital links. Digital links 1025 and 1035 interface with CBX 1030 by means of a ROLMLink Interface (RLI) unit (not shown), which RLI separates data transmission between a DCM and a CBX from status/configuration transmission therebetween. Since there is a constant transmission of status/configuration information between a DCM and a CBX, an RLI card which interfaces with a DCM, for example, DCM 1020 of FIG. 1, will detect the fact that DCM 1020 is disconnected from ROLMLink 1025 which connects DCM 1020 to CBX 1030. This disconnect detection event is transmitted to CBX 1030 as status information for analysis. In accordance with the present invention, CBX 1030 comprises an application program which receives the status information—the status information comprises an indication that a DCM disconnect event has occurred as well as configuration information which identifies the particular DCM whose disconnect was detected. The application program in CBX 1030 transfers the status information to theft and alarm system monitor 1050.

Theft and alarm system monitor 1050 is comprised of a local database 1060 or has access to a centralized database. Database 1060 stores geographical information and so forth relating to the DCMs. Theft and alarm system monitor 1050 utilizes the status information it receives from CBX 1030 as a retrieval key to access database 1060 and to retrieve information which relates to the disconnected DCM. Then, theft and alarm system monitor generates a report which identifies the particular DCM which was disconnected. The report may be printed at a terminal in a central location and/or may be printed at security location in the vicinity of the disconnected DCM and/or may be printed at a security dispatch location and so forth.

In accordance with the present invention, whenever data processing equipment or electronic equipment 1000 is disconnected from DCM 1020, theft detection and alarm system 1010 generates an alarm data signal which is transmitted to DCM 1020 and, optionally, theft detection and alarm system 1010 generates an alarm at its physical location. In response to the data signal from theft detection and alarm system 1010, DCM 1020 transmits an alarm status code to CBX 1030. In response, the above-described applications program in CBX 1030 transmits the alarm status code to theft and alarm system monitor 1050 along with configuration information related to DCM 1020. Once again, theft and alarm system monitor 1050 utilizes the status information, including the DCM configuration information, as a retrieval key to access database 1060 and to retrieve information which relates to the disconnected equipment. Then, theft and alarm system monitor generates a report which identifies the particular equipment which was disconnected. The report may be printed at a terminal in a central location and/or may be printed at security location in the vicinity of the disconnected DCM and/or may be printed at a security dispatch location and so forth.

In either case, whether DCM 1020 or data processing or electronic equipment 1000 is disconnected, theft detection and alarm system monitor 1050 can send a message, in a manner which is well known to those of ordinary skill in the art, to a security terminal and/or cause an alarm to be sounded in the area of the disconnected equipment and/or place a telephone call to a predetermined security location and/or transmit a predetermined message to an external loud speaker, using CBX 1030. Further, various such strategies could be implemented as various times during the day. For example, alarm generations in response to disconnect information may be disabled at theft alarm system monitor 1050 during the day and activated during the night or on the week-end when most thefts are expected to occur. Further, alarm generation in response to disconnect information may be disabled at theft alarm system monitor 1050 on an equipment or location basis to enable one to move equipment.

Figure 2:
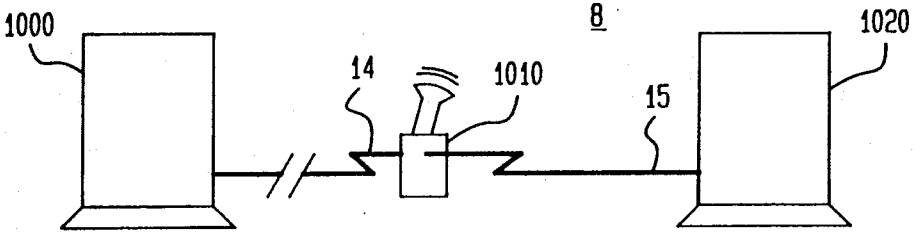
FIG. 2 is a schematic drawing of an embodiment of a theft detection and alarm system which is fabricated in accordance with the present invention.

FIG. 2 shows a schematic drawing wherein theft detection and alarm system 1010 is coupled to electronic unit 1000 through cable 14 and to second electronic unit 1020, for example, DCM 1020, through cable 15. Although electronic units 1000 and 1020 can be any type of conventional electronic device such as computers, modems, printers, or the like, which are connectable to each other, as shown in FIG. 1, a preferred embodiment of the present invention is fabricated wherein electronic unit 1020 is a DCM. A preferred embodiment of theft detection and alarm system 1010 is designed to operate in accordance with the EIA-232-D standard.

In operation, theft detection and alarm system 1010 monitors signal current which is transmitted between the electronic units 1000 and 1020 through cables 14 and 15. The EIA-232-D standard specifies that whenever an EIA-232-D unit is powered on and interconnected with another EIA-232-D unit, there is signal current between the interconnected units. The signal current may consist of any one of various types of electrical energy. For example, the signal current may be a bit stream communicating data in digital form, a status signal, or an analog signal. The EIA-232-D standard contemplates that the signal current may be driven by a positive or negative voltage. The standard also contemplates that the driving voltage of the signal current shall be between −5 and −25 volts or +5 and +25 volts. During data transmission, the driving voltage may make transitions in a range of −5 volts to +5 volts for a period of time no longer than 1 millisecond.

Theft detection and alarm system 1010 produces an audible alarm signal whenever there is a sustained absence of signal current in either of cables 14 and 15 and it sends an alarm data signal to electronic unit 1020 if, for example, electronic unit 1020 is embodied as a DCM and there is an absence of current in cable 14. In the configuration shown in FIG. 2, a sustained absence of signal current (e.g., for greater than one millisecond) occurs only when either of cables 14 or 15 is disconnected or severed, or when power to both of electronic units 1000 and 1020 is turned off. Thus theft detection and alarm system 1010 functions as an effective theft deterrent for either or both of the units 1000 and 1020. In FIG. 2, for example, cable 14 is shown severed and theft detection and alarm system 1010 is shown producing an audible alarm and sending a signal to DCM 1020.

Figure 3:
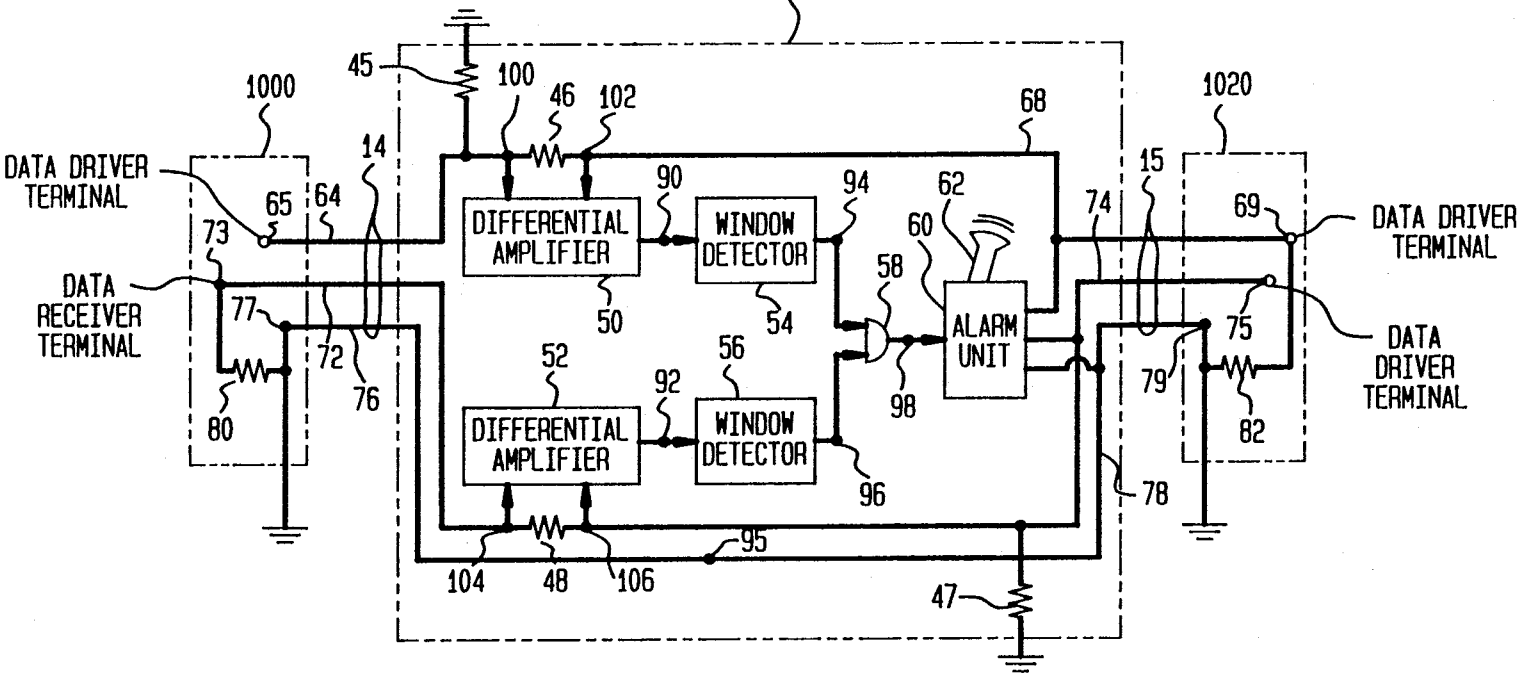
FIG. 3 shows symbolically the theft detection and alarm system of FIG. 1 with schematic illustrations of internal portions of a theft detection unit thereof and of electronic units thereof.

FIG. 3 shows a preferred embodiment of theft detection and alarm system 1010 which is fabricated in accordance with the present invention. Theft detection and alarm system 1010 is coupled via cable 14 to electronic unit 1000 (shown as a dashed line rectangle) and via cable 15 to electronic unit 1020 (shown as a dashed line rectangle). Theft detection and alarm system 1010 comprises first and second sensing resistors 46 and 48, third and fourth pull down resistors 45 and 47, first and second differential amplifiers 50 and 52, first and second window detectors 54 and 56, AND gate 58, and alarm unit 60. Alarm unit 60 has an input and speaker 62.

A first end of first wire 64 of cable 14 is coupled to transmitted data driver terminal 65 of electronic unit 1000 and a second end of wire 64 is coupled to first terminals of resistors 45 and 46, to first input of differential amplifier 50 and to terminal 100. The second input of differential amplifier 50 is coupled to a second terminal of resistor 46, to first end of first wire 68 of cable 15 and to terminal 102. A second end of wire 68 is coupled to transmitted data receiver terminal 69 of electronic unit 1020.

A first end of second wire 72 of cable 14 is coupled to transmitted data receiver terminal 73 of electronic unit 1000. A second end of wire 72 is coupled to a first terminal of resistor 48, to first input of differential amplifier 52 and to terminal 104. The second input of differential amplifier 52 is coupled to a second terminal of resistor 48, to a first terminal of resistor 47, to a first end of second wire 74 of cable 15 and to terminal 106. A second end of wire 74 is coupled to transmitted data driver terminal 75 of electronic unit 1020. Second terminals of resistors 45 and 47 are coupled to a reference potential which is shown as ground.

A first end of third wire 76 of cable 14 is coupled to signal ground terminal 77 of electronic unit 12. A first end of third wire 78 of cable 15 is coupled to terminal 95. A second end of wire 78 is coupled to signal ground terminal 79 of electronic unit 1020. Electronic units 1000 and 1020 form passive resistive loads across their respective signal ground terminals 77 and 79 and their respective data receiver terminals 73 and 69. These passive resistive loads are shown symbolically as resistors 80 and 82, respectively, in FIG. 3.

The output of differential amplifier 50 is coupled to the input of window detector 54 and to terminal 90. The output of differential amplifier 52 is coupled to the input of window detector 56 and to terminal 92. The output of window detector 54 is coupled to the first input of AND gate 58 and to terminal 94. The output of window detector 56 is coupled to the second input of AND gate 58 and to terminal 96. The output of AND gate 58 is coupled to the input of alarm unit 60 and to terminal 98.

In operation, theft detection and alarm system 1010 senses the presence or absence of signal currents in cables 14 and 15 and produces an alarm signal comprising an audible alarm via alarm unit 60 and an alarm data signal which is transmitted to unit 1020 when unit 1020 is a DCM whenever a sustained absence of signal current is sensed in either of cables 14 and 15.

Alarm unit 60 is activated only when both of the window detectors 54 an 56 produce a high output signal, i.e., a logic "1" signal. Window detector 54 produces a "1" output signal only when there is no signal current passing through resistor 46. Window detector 56 produces a "1" output signal only when there is no signal current passing through resistor 48. An absence of signal current in both of resistors 46 and 48 results from an absence of signal current in either of cables 14 or 15. As explained below, this absence of signal current is indicative of one or both of cables 14 and 15 being severed or disconnected.

The method of sensing of signal currents in the cables 14 and 15 can be understood by considering the operation of one portion of theft detection and alarm system 1010. A voltage drop occurs across resistor 46 whenever signal current is passing through resistor 46. Resistor 46 has a relatively low ohmic value so that the voltage drop thereacross does not inordinately effect the signal being transmitted from electronic unit 1000 to electronic unit 1020. Indeed, the value of resistor 46 is selected to produce a voltage drop no greater than 5% of the voltage applied to data driver terminal 65. The EIA-232-D standard contemplates that the voltage at the data driver terminal may be in ranges of +5 to +25 volts and −5 to −25 volts. Accordingly, the value of resistor 46 is selected such that, with maximum current flow therethrough, the voltage drop thereacross is in ranges of +0.25 to +1.25 volts and −0.25 to +1.25 volts. The voltage drop across resistor 46 can be much lower than p0.25 volts if load resistance 82 is greater than the EIA-232-D minimum of 3000 ohms.

When signal current is passing through resistor 46, differential amplifier 50 amplifies the voltage drop across resistor 46. In a typical embodiment, this amplification assures that the voltage presented to the input of window detector 54 is outside a range of +0.5 to −0.5 volts. Window detector 54 produces a "1" output signal whenever its input is presented with a voltage in a range of +0.5 to −0.5 volts. Whenever a voltage outside of that range is presented to the input of window detector 54, it produces a low output, a logical "0" (e.g., a voltage within several tenths of a volt of zero volts). Consequently, window detector 54 produces a "0" output whenever signal current is present in resistor 46.

Whenever there is no signal current in resistor 46, there is no voltage drop thereacross and differential amplifier 50 presents a zero voltage at terminal 90 and to the input of window detector 54. A zero voltage input to window detector is, of course, within the range of +0.5 to −0.5 volts. Consequently window detector 54 produces a "1" at terminal 94 in response to an absence of signal current in resistor 46.

The signal current in resistor 46 may be driven by a positive or a negative voltage. In either case window detector 54 produces a "1" output signal in response to an absence of signal current in resistor 46 and a "0" output signal in response to a presence of signal current in resistor 46.

In a similar manner, the combination of resistor 48, differential amplifier 52 and window detector 56 produces a "1" at the output (terminal 96) of window detector 56 whenever there is an absence of signal current in resistor 48. Correspondingly, a "0" output signal is produced when a signal current is present in resistor 48. Additional details of operation of differential amplifier 50 and window detector 54 are described below.

When both of the outputs of window detectors 54 and 56 produce "1's", AND gate 58 produces a "1" at terminal 98. Alarm unit 60 is activated when a "1" is applied to its input (terminal 98). Thus the alarm unit 60 is activated whenever there is an absence of signal current in both of resistors 46 and 48.

Alarm unit 60 remains in an inactive state whenever there is signal current present in either of resistors 46 or 48. If signal current is present in either of resistors 46 or 48, the window detector associated with that resistor produces a "0" at the output thereof. AND gate 58 thus receives at least one "0" at one of its inputs and consequently produces a "0" at its output terminal 98. Accordingly, alarm unit 60 remains inactive (i.e., does not produce an audible alarm or an alarm data signal).

In order to understand the usefulness of the above described arrangement, it must be realized that in order for signal current to flow in either of cables 14 or 15, there must be two conditions present. First, there must be a positive or negative data driver voltage applied to wire 64 or wire 74. Second, there must be a current path between wires 72 and 76 and between wires 68 and 78. This current path between these sets of wires is formed through electronic units 1000 and 1020. Each of electronic units 1000 and 1020, in accordance with the EIA-232-D standard, presents a resistive load of between 3000 and 7000 ohms across wires 72 and 76 and across wires 68 and 78 at the points where these sets of wires connect to their respective terminals on electronic units 1000 and 1020. The resistive loads are shown as resistors 80 and 82, respectively.

An exemplary benefit of the arrangement of theft detection and alarm system 1010 can be understood by considering the results of severing one of the cables, for example, cable 14. When cable 14 is severed, those portions of the wires 72 and 76 which are inside theft detection and alarm system 1010 are no longer connected to the passive resistive load of electronic unit 1000. This discontinuity results in a cessation of signal current in wire 72 and resistor 48. Also, because cable 14 is severed, data driver terminal 65 of electronic unit 1000 is disconnected from resistor 46. The combination of these events results in an absence of signal current in resistors 46 and 48. Consequently, each of window detectors 54 and 56 produces a "1." The "1"s are applied to the inputs of AND gate 58 and, in response, AND gate 58 produces a "1" at terminal 98. This "1" at terminal 98 causes alarm unit 60 to generate an audible warning and to generate an alarm data signal which is transmitted over cable 15 to DCM 1020.

As one of ordinary skill in the art can readily appreciate, a similar result is produced if cable 15 is severed or disconnected, except for the transmission of an alarm data signal to equipment 1020.

Figure 4:
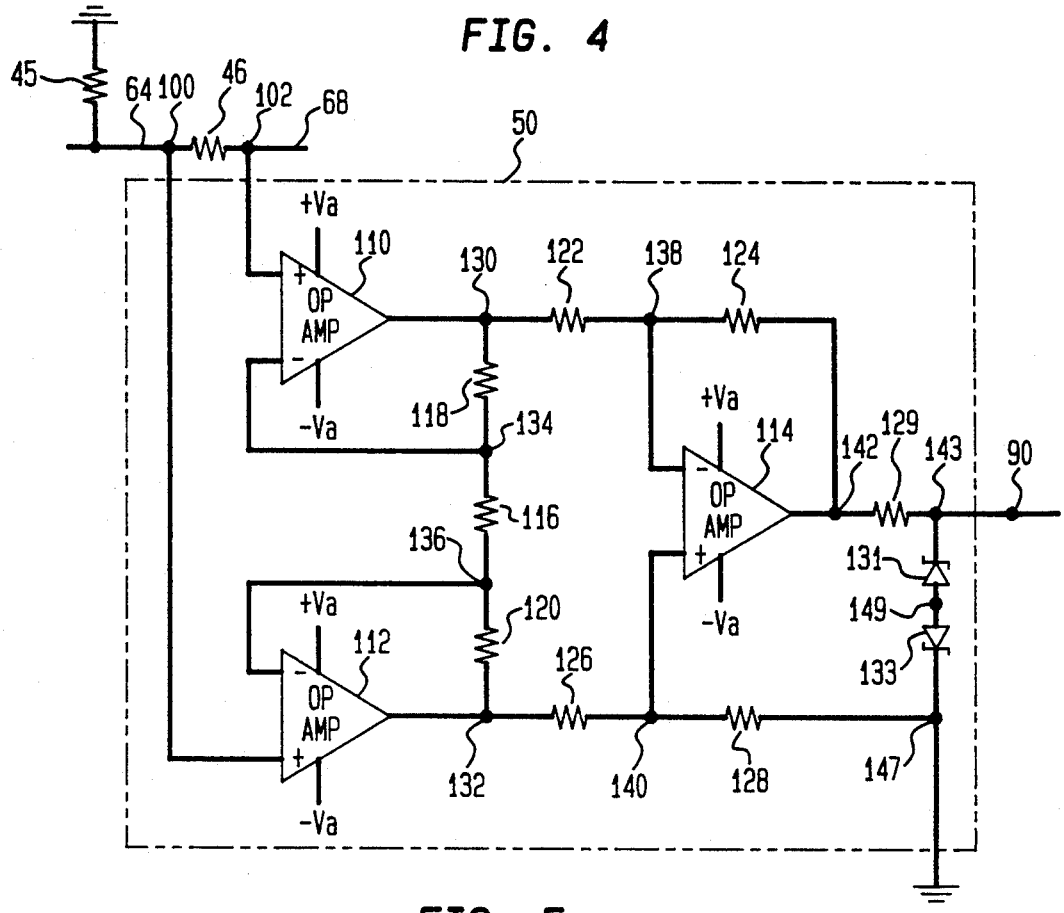
FIG. 4 is a detailed schematic illustration of a differential amplifier portion of the theft detection and alarm system of FIG. 1.

FIG. 4 shows a circuit diagram of a preferred embodiment of differential amplifier 50 (shown within a dashed line rectangle) of FIG. 3. Differential amplifier 50 is shown coupled to resistors 45 and 46 and to terminal 90 of FIG. 3. Differential amplifier 50 comprises first, second and third operational amplifiers 110, 112 and 114, respectively, resistors 116, 118, 120, 122, 124, 126, 128 and 129, respectively, and a pair of zener diodes 131 and 133. Operational amplifiers 110, 112 and 114 each have a positive input, a negative input and an output. One type of operational amplifier that is useful in practicing the present invention is a 1480 Operational Amplifier available from Teledyne-Philbrick. With the exclusion of resistor 129 and zener diodes 131 and 133, differential amplifier 50 is essentially identical to the differential amplifier shown and described in "The Art of Electronics" by Horowitz and Hill, published by the Press Syndicate of the University of Cambridge, 1984 edition at pages 282 and 283.

A second terminal of resistor 128 is coupled to terminal 147, to a cathode of zener diode 133 and to a reference voltage which is shown as ground. In a preferred embodiment, zener diodes 131 and 133 have a breakdown voltage of 12 volts. One example of a diode useful in the preferred embodiment of the present invention is known as a type 1N3022 Zener Diode.

In operation, differential amplifier 50 produces an amplification of the voltage drop between terminals 100 and 102 of resistor 46 which occurs whenever there is signal current passing through resistor 46. Differential amplifier 50 in a preferred embodiment of the present invention produces a differential gain of approximately eleven and resistors 45 and 46 are 100,000 ohms and 130 ohms, respectively. The value of resistor 46 is selected so as not to introduce a voltage drop any greater than 5% in wire 64 when the load, i.e., resistor 82, of electronic unit 1020 is at the minimum level permitted by the EIA-232-D standard, i.e., 3000 ohms. The EIA-232-D standard specifies that the load impedance as seen by the driving terminal must be in the range of 3000 to 7000 ohms. The values given above for resistors 45 and 46 assure that this standard is met when theft detection and alarm system 1010 is used in conjunction with electronic units which conform to the EIA-232-D standard.

Differential amplifier 50 produces a maximum output voltage at terminal 90 of approximately ±12 volts when data driver terminal 65 of electronic unit 1000 of FIG. 3 is driven with the maximum voltage permitted by the EIA-232-D standard, i.e., ±25 volts, and the load resistance is at the EIA-232-D minimum of 3000 ohms. Differential amplifier 50 produces a minimum output voltage at terminal 90 of approximately ±1 volt when data driver terminal 65 is driven with the minimum voltage permitted by the EIA-232-D standard, i.e., ±5 volts, and the load resistance is at the EIA-232-D maximum of 7000 ohms. Resistor 129 and zener diodes 131 and 133 are placed at the output of the differential amplifier 50 to assure that window detector 54 is not exposed to any input voltages that exceed 12 volts. Because zener diodes 131 and 133 are arranged as an opposed pair, they afford protection from excess output voltages that are both positive and negative.

Operational amplifiers 110, 112 and 114 are each powered via connections between power supply sources (not shown) having voltage levels +Va and −Va. In a typical embodiment, +Va is +35 volts, −Va is −35 volts, resistor 116 is 1000 ohms, resistors 118 and 120 are each 5000 ohms, resistors 122, 124, 126 and 128 are each 10,000 ohms, and resistor 129 is 560 ohms.

Differential amplifier 52 of FIG. 3 has essentially the same structure as differential amplifier 50 of FIG. 4 and functions in the same manner. Resistors 47 and 48 typically are 100,000 ohms and 130 ohms, respectively.

Pull down resistors 45 and 47 (both shown in FIG. 3 and only resistor 45 being shown in FIG. 4) provide high impedance paths to ground and thus do not, in any substantial way, interfere with the interaction between electronic units 1000 and 1020. Their presence is important. Without them, an act of severing or disconnection of both of the cables 14 and 15 simultaneously would produce an indeterminate output signal at terminals 90 and 92 because the inputs of differential amplifiers 50 and 52 would float in potential. This would generate a set of conditions wherein the output of AND gate 58 could be a "1" or a "0". Resistors 45 and 47 cause terminals 100 and 106 to be at ground potential if cables 14 and 15 are severed or disconnected and this condition results in an activation of alarm unit 60.

Figure 5:
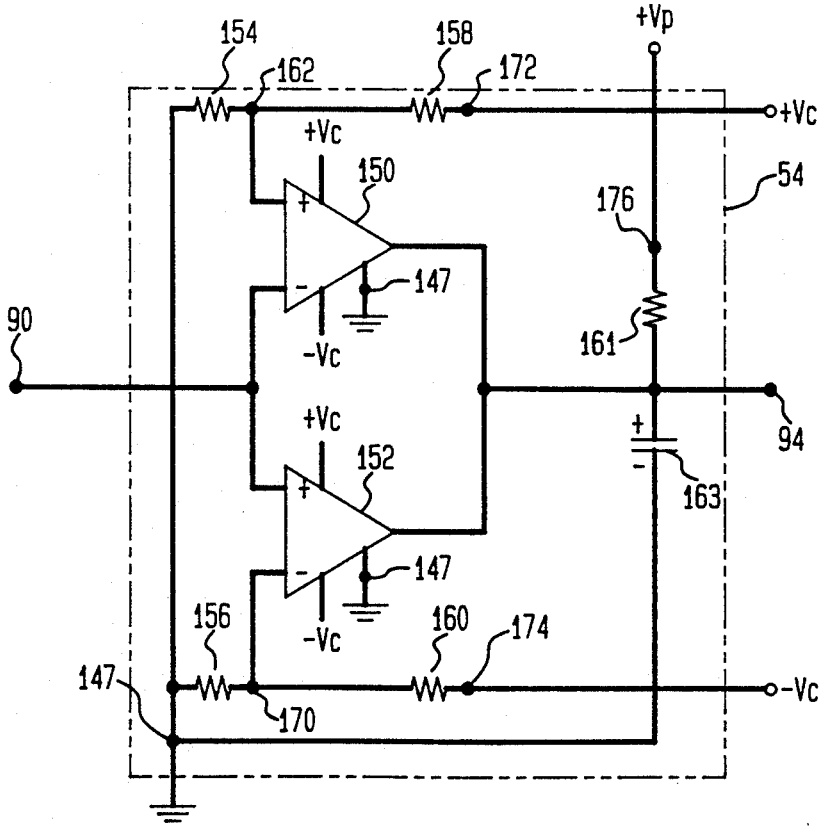
FIG. 5 shows a detailed schematic illustration of a window detector portion of the theft detection and alarm system of FIG. 1.

FIG. 5 shows a circuit diagram of a preferred embodiment of window detector 54 (shown within a dashed line rectangle) of FIG. 3. Window detector 54 is shown coupled between terminals 90 and 94 of FIG. 3. Window detector 54 comprises first and second comparators 150 and 152, resistors 154, 156, 158, 160, and 161, and capacitor 163. Window detector 54, with the exception of capacitor 163, is similar in structure to the window detector shown in "Linear Databook 1986", published by Linear Technology Corporation at page 5-14.

Comparators 150 and 152 each have a positive input, a negative input and an output. One type of comparator that is useful in practicing the present invention is a LM311 Comparator available as an industry standard.

Terminals of resistors 154 and 156 are coupled to terminal 147 and to a reference voltage which is shown as ground. A second terminal of the resistor 158 is coupled to a terminal 172 and to a power source (not shown) having a positive voltage of +Vc. A terminal of resistor 160 is coupled to terminal 174 and to a power source (not shown) having a negative voltage of −Vc. A terminal of the resistor 161 is coupled to terminal 176 and to a power source (not shown) having a positive voltage of Vp.

In operation, in a typical embodiment, window detector 54 produces a "1" at terminal 94 whenever the input voltage at terminal 90 is between +0.5 and −0.5 volts. Differential amplifier 50 of FIG. 3 produces essentially a zero voltage level at terminal 90 when there is an absence of signal current through resistor 46 of FIG. 3. Thus window detector 54 responds to an absence of signal current in resistor 46 by producing a "1" at terminal 94.

Each of comparators 150 and 152 typically has an n-p-n type output transistor (not shown) whose collector is coupled to an output terminal of its comparator and whose emitter is coupled to terminal 147 which is shown coupled to ground. When the output terminals of comparators 150 and 152 are coupled together to a common pull-up resistor (e.g., resistor 161), there is implemented a "wired OR" logic function. Accordingly, when either of comparators 150 or 152 tries to produce a "0", there is a "0" produced at terminal 94.

Whenever signal current is present in resistor 46 of FIG. 3, differential amplifier 50 produces an output at terminal 90 that is either greater than +0.5 volts or less than −0.5 volts. When the voltage at terminal 90 is greater than +0.5 volts, comparator 150 tries to produce a "0" at terminal 94 and comparator 152 tries to produce a "1" at terminal 94. When the voltage at terminal 90 is less than −0.5 volts, comparator 150 tries to produce a "1" at terminal 94 and comparator 152 tries to produce a "0" at terminal 94. Both of these conditions result in a "0" at terminal 94.

Terminal 94 is at a voltage level of +Vp, a "1", whenever the outputs of comparators 150 and 152 do not draw current. Whenever the voltage at terminal 90 is between −0.5 volts and +0.5 volts, comparator 150 tries to produce a "1" at terminal 94, and comparator 152 tries to produce a "1" at terminal 94. This results in a "1" at terminal 94.

The R-C time constant associated with resistor 161 and capacitor 163 prevents the voltage at terminal 94 from changing instantaneously. This resistor-capacitor network effectively blocks or prevents the transmission of any changes of state of the output of window detector 54 which are shorter in duration than 50 milliseconds. The EIA-232-D standard contemplates that signal voltages are in the range of +5 to −5 volts for periods no longer than 1 millisecond. Thus, a change of state of the input of window detector 54 which exceeds 50 milliseconds clearly represents an abnormal disruption of signal current and results in a change in the state at the output (terminal 94) of window detector 54. However, an embodiment of the present invention may be fabricated wherein a change of state of the input of window detector 54 which exceeds a period of time permitted by the EIA-232-D standard represents an abnormal disruption of signal current.

In a typical embodiment, Vp is +5 volts, +Vc is +15 volts, −Vc is −15 volts, resistors 154 and 156 are 1000 ohms each, resistors 158 and 160 are 29,000 ohms each, resistor 161 is 2000 ohms, capacitor 163 is 15 microfarads, and +Vc and −Vc are used to power comparators 150 and 152. With these values of voltages and resistances, DC voltage levels of +0.5 volts and −0.5 volts exist at terminals 162 and 170, respectively.

Window detector 56 of FIG. 3 has essentially the same structure as window detector 54 described above. It differs only in that it is coupled to differential amplifier 52 and to the second input of AND gate 58.

Referring back now to FIG. 3, it can be seen that when "1's" are produced at the outputs (terminals 94 and 96) of window detectors 54 and 56, AND gate 58 produces a "1" at terminal 98 which causes alarm unit 60 to emit an audible alarm and to generate an alarm data signal for transmission to DCM 1020 over cable 15. Accordingly, alarm unit 60 sets off an audible alarm and generates an alarm data signal whenever cable 14 or cable 15 is severed or disconnected, as in the case when there is a theft of either of electronic units 1000 or 1020. However, the alarm data signal will reach equipment 1020 whenever cable 15 is not severed or disconnected.

In the context of the present invention, various elements and combinations of elements of theft detection and alarm system 1010 function as logic units. For example, the following functions as a logic unit: (a) each of comparators 150 and 152; (b) each pair of comparators 150 and 152 when combined in window detectors 54 and 56; (c) each of the window detectors 54 and 56; and (d) the combination of window detectors 54 and 56 and AND gate 58. Accordingly all of these elements and combinations of elements are denoted as logic units.

Figure 6:
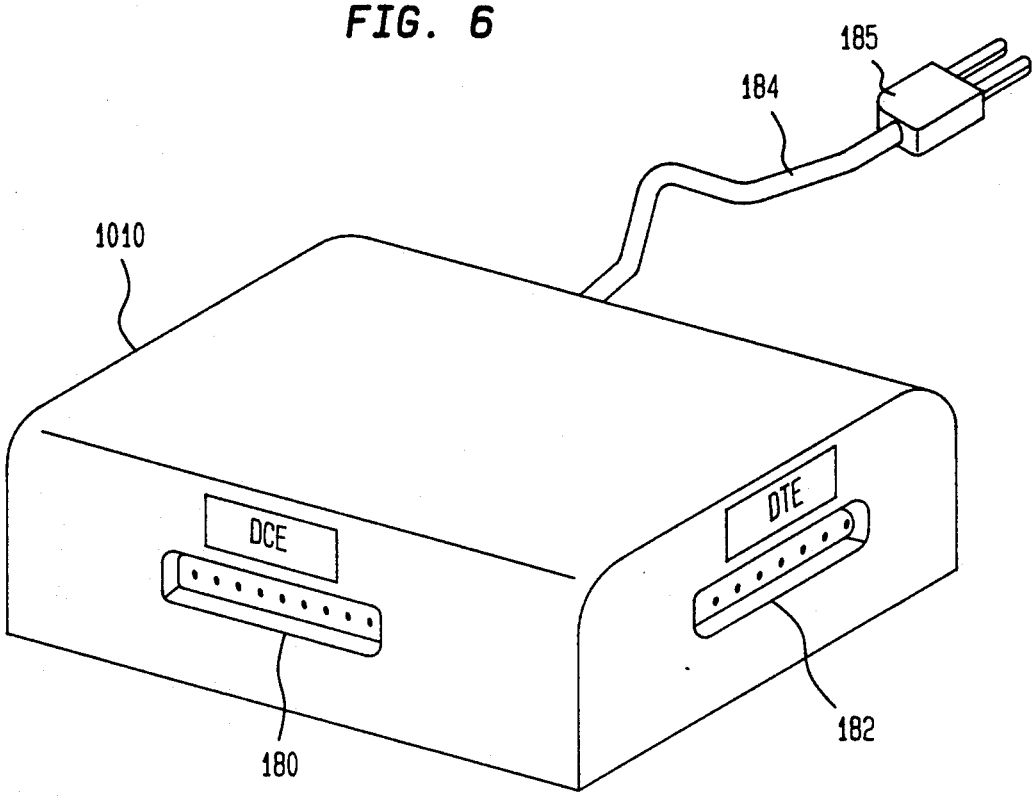
FIG. 6 shows a physical embodiment of a theft detection unit which is employed in the theft detection and alarm system of FIG. 1.

FIG. 6 shows a physical embodiment of theft detection and alarm system 1010. Theft detection and alarm system 1010 shown in FIG. 6 is constructed so that it can be installed between electronic units that operate in accordance with the EIA-232-D standard. EIA-232-D conforming electronic units are provided with conventional 25 pin cable jacks. Theft detection and alarm system 1010 is provided with corresponding 25 pin jacks. On one side of theft detection and alarm system 1010 jack 180 of an EIA-232-D standard 25 pin connector; jack 180 is labeled DCE (Data Circuit-terminating Equipment). On another side of theft detection and alarm system 1010 is jack 182 of an EIA-232-D standard 25 pin connector; jack 182 is labeled DTE (Data Terminal Equipment). Theft detection and alarm system 1010 is also provided with power cord 184 having male plug 185 which is adapted to be plugged into a conventional power receptacle. Power cord (cable) 184 allows connection of theft detection and alarm system 1010 to an external source of AC or DC power. Theft detection and alarm system 1010 comprises power supply circuitry (not shown) which generates the voltages needed for the operation thereof. In a preferred embodiment, a rechargeable battery (not shown) is placed within theft detection and alarm system 1010. If power cord 184 is disconnected, the internal battery powers the components of theft detection and alarm system 101. Thus, the removal of power cord 184 does not disable theft detection and alarm system 1010.

The significance of labeling of jacks 180 and 182 can be understood by referring back to FIG. 3. For illustrative purposes, electronic unit 1000 is described as a DCE device in accordance with the nomenclature of the EIA-232-D standard and electronic unit 1020 is described as a DTE device in accordance with the EIA-232-D nomenclature. Within the scope of the invention, units 1000 and 1020 may be either DTE or DCE devices.

In accordance with the EIA-232-D standard, there are certain pins of the 25 pin connectors which are consistently used for driving data, for receiving data and for signal ground connections. In the following description, reference is made to these pin designations even though the pins are not explicitly shown in the drawings.

Because electronic unit 1000 is shown as a DCE device, in accordance with the EIA-232-D standard, the signal current is transmitted out of this unit on PIN 3 of its 25 pin jack. Signal current is received by electronic unit 1000 through PIN 2 of its 25 pin jack. Also, in accordance with the EIA-232-D standard, a signal ground return is connected to PIN 7 of its 25 pin jack. Therefore jack 180, labeled DCE, is arranged so that its PIN 3 will be connectable with terminal 65 shown in FIG. 3. Similarly, PIN 2 of jack 180 will be connectable with terminal 73 and PIN 7 of jack 180 will be connectable with terminal 77 shown in FIG. 3.

Because electronic unit 1020 is shown as a DTE device, in accordance with the EIA-232-D standard, the signal current is transmitted out of this unit on PIN 2 of its 25 pin jack. Signal current is received by electronic unit 1020 through PIN 3 of its 25 pin jack. Also, in accordance with the EIA-232-D standard, a signal ground return is connected to PIN 7 of its 25 pin jack. Therefore jack 182, labeled DTE, is arranged so that its PIN 2 will be connectable with terminal 75 shown in FIG. 3. Similarly, PIN 3 of jack 182 will be connectable with terminal 69 and PIN 7 of jack 182 will be connectable with terminal 79 shown in FIG. 3. Of course, those of ordinary skill in the art recognize that all 25 pins of the EIA-232-D connector do not necessarily need to be used.

Installation of theft detection and alarm system 1010 occurs by plugging first end of a first conventional 25 pin connector cable into conventional 25 pin jack on a DCE electronic unit. A second end of the first connector cable is plugged into jack 180. A first end of a second conventional 25 pin connector cable is plugged into a conventional 25 pin jack on a DTE electronic unit. A second end of the second connector cable is plugged into jack 182. One or both of the electronic units is turned on. Power cord 184 is plugged into a power receptacle. Theft detection and alarm system 1010 is then operational.

Theft detection and alarm system 1010 can be installed between two DTE electronic units or between two DCE electronic units. In these cases, a conventional null modem must be plugged into one of jacks 180 or 182.

Figure 7:
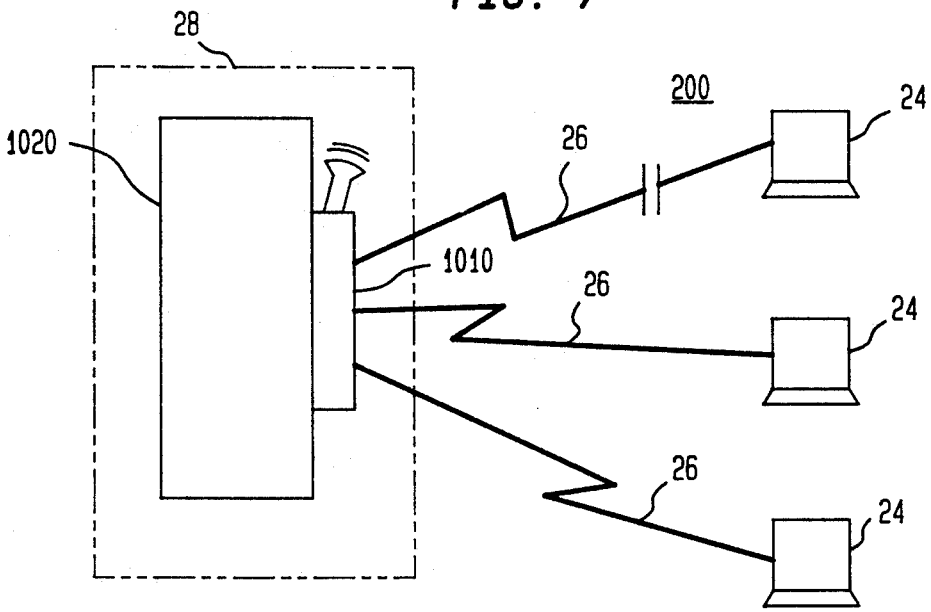
FIG. 7 shows schematically another theft detection and alarm system in accordance with the present invention.

FIG. 7 shows theft detection and alarm system 1010 being connected to electronic unit 1020 and to a plurality of electronic units 24 by means of a plurality of cables 26. Cables 26 carry signal current between electronic unit 1020 and electronic units 24. Theft detection and alarm system 1010, through a conventional multiplexing circuit (not shown) continually monitors the signal current which passes through cables 26. Whenever one of cables 26 is severed or disconnected (as is shown in FIG. 7), theft detection and alarm system 1010 produces an alarm signal and sends an alarm data signal to electronic equipment 1020, for example, a DCM. The alarm signal itself may be audible or, if desired, the alarm signal may be transmitted to a location remote from electronic unit 1020 to notify security personnel that a theft is occurring.

In a typical application, electronic unit 1020 is a DCM and electronic units 24 are desk-top computers.

Electronic unit 1020 is shown, symbolically, located in a secure room or remote location designated by a dashed line rectangle 28. This configuration eliminates a need for an internal battery for theft detection and alarm system 1010. A person seeking to steal one of electronic units 24 typically does not have access to theft detection and alarm system 1010 and thus is not able to remove theft detection and alarm system 1010 from its source of power. Further, theft detection and alarm system 1010 can be constructed as an internal component of the electronic unit 1020.

Theft detection and alarm system 1010 may include a multiplexing circuit. However if electronic unit 1020 has available multiplexing capability, an additional multiplexing circuit is not required in theft detection and alarm system 1010. Additionally, the power needs of theft detection and alarm system 1010 may be provided directly from a power supply of electronic unit 1020. It is also possible that theft detection and alarm system 1010 will not contain an internal alarm unit.

These and other design variations are dependent on whether or not theft detection and alarm system 1010 is produced as a separate unit to be attached to a preexisting electronic unit or is produced as an integral element of the electronic unit.

It is to be understood that the specific designs and methods described as exemplary embodiments are merely illustrative of the spirit and scope of the invention. Modifications can be made in the specific designs and methods consistent with the principles of the invention. For example, although the invention has been described in the context of monitoring a signal current that conforms to the EIA-232-D standard, it has application to monitoring of virtually any form of signal current. Still further, the invention can be employed to deter theft of electronic units which are operated in a mode in which signal currents pass in just one direction. In this case, current sensing circuitry for the present invention requires only one comparator for each conductor of signal current rather than the pair of comparators used for each conductor as described above. Still further, the inventive principles disclosed herein can be applied to deter theft of electronic units that are coupled with a single conductor or any number of conductors. Furthermore, the output of AND gate 58 could be coupled to alarm unit 60 through a latch circuit instead of being directly coupled thereto. This would keep the alarm activated (producing an audible alarm) for a preselected period of time even if a severed or disconnected cable is quickly replaced.

What is claimed is:

1. Apparatus for detecting theft of an electronic unit which sends or receives signal current, which signal current is generated by or in response to a power supply within or without the unit, the apparatus comprising:

means for sensing an interruption of the signal current and for producing an alarm signal whenever the signal current is interrupted for a period of time greater than a predetermined time period;

means for receiving the alarm signal and, in response, for providing alarm status and equipment configuration information relating to the electronic unit to a theft detection and alarm monitor means; and the theft detection and alarm monitor means comprising:

means for accessing a database, using at least a portion of the alarm status and configuration information as a retrieval key, to obtain reporting information and for transmitting the reporting information to reporting means; and said reporting means for receiving the reporting information and, in response to the reporting information, for providing a report.

2. The apparatus of claim 1 wherein the reporting means provides a report by transmitting a message to at least one predetermined center.

3. The apparatus of claim 2 wherein the means for receiving the alarm signal and, in response, for providing alarm status and equipment configuration information comprises:

data switching means for receiving the alarm signal and for retrieving the alarm status and equipment configuration information in response thereto; the data switching means further comprising data switching and transmission means for transmitting the alarm status and equipment configuration information information to the theft detection and alarm monitor means.

4. Apparatus for detecting theft of an electronic unit which sends or receives signal current, which signal current is generated by or in response to a power supply within or without the unit, the apparatus comprising:

means for sensing an interruption of the signal current and for producing an alarm signal whenever the signal current sensed interruption occurs for a period of time greater than a predetermined time period;

wherein the means for sensing an interruption comprises:

a logic unit for producing output signals of at least two different states;

means for interconnecting the logic unit with a conductor of the signal current such that an output signal of the logic unit is indicative of a presence of the signal current when in one state and an absence of the signal current when in the other state;

means for transmitting the output signal of the logic unit to the means for producing an alarm signal; and means for preventing a transmission of a change of state of the output signal of the logic unit to the means for producing an alarm whenever the absence of signal current exists for a period of time less than the predetermined time period, whereby an interruption is sensed irrespective of whether the signal current is driven by a positive or negative voltage.

5. The apparatus of claim 4 wherein the means for preventing comprises a resistor-capacitor combination coupled to the output of the logic unit.

6. Apparatus for detecting theft of an electronic unit which, during normal operation, sends or receives signal current in accordance with EIA-232-D standards, which signal current is generated by or in response to a power supply within or without the unit, the apparatus comprising:

means for sensing an interruption of the signal current; and means for producing an alarm signal whenever the signal current is interrupted for a period of time greater than a period of time permitted by the EIA-232-D standard for signal related transitions of signal voltage within a range of +5 volts to −5 volts.

7. Apparatus for detecting theft of an electronic unit which sends or receives signal current, which signal current is generated by or in response to a power supply within or without the unit, the apparatus comprising:

means for sensing an interruption of the signal current and for producing an alarm signal whenever the signal current sensed interruption occurs for a period of time greater than a predetermined time period;

a housing;

jack portions of industry standard cable connectors located on said housing; and the means for sensing interruptions of signal currents being adapted to interconnect with signal current output and input pins of two or more of the electronic units when the jack portions of the apparatus are connected with industry standard jacks of the electronic units.

8. The apparatus of claim 7 further comprising a battery that powers the apparatus when the apparatus is disconnected from the electronic units.

9. The apparatus of claim 8 wherein the battery is a rechargeable battery.

10. Apparatus for detecting theft of interconnected, signal current producing electronic units, which signal current is generated by or in response to a power supply within or without the units, the apparatus comprising:

an alarm unit;

a conductor of signal current;

means for coupling the conductor of signal current to the electronic units such that the signal current produced by the electronic units is carried on the conductor;

a resistor interposed in the conductor of signal current;

a detector for detecting a presence or absence of a voltage drop across the resistor; and the detector being adapted to activate the alarm unit when and only when there is essentially no voltage drop across the resistor.

11. The apparatus of claim 10 further comprising:

amplifier means for amplifying the voltage drop across the resistor;

the amplifier means being interposed between terminals of the resistor and an input of the detector such that an input of the detector is presented with a voltage that has an absolute value greater than the absolute value of any finite voltage drop across the resistor.

12. The apparatus of claim 10 wherein the detector comprises:

at least one comparator having first and second input terminals and an output terminal;

the first terminal being coupled to a source of power that produces a predetermined voltage at the first input terminal;

the second terminal being coupled to a source of voltage that is a function of the voltage drop across the resistor; and the comparator being adapted to produce, at the output terminal thereof, a first output state when there is a voltage drop across the resistor and to produce a second different output state when there is essentially no voltage drop across the resistor.

13. The apparatus of claim 12 further comprising:

a second comparator which is essentially identical to the first comparator;

the comparators having their output terminals coupled together and coupled to an input of the alarm unit;

the comparators being adapted to produce a combined output signal that activates the alarm unit when and only when there is essentially no voltage drop across the resistor.

14. The apparatus of claim 15 further comprising means for preventing a transmission of the alarm activating signal to the alarm unit for a period of time that exceeds a predetermined time period.

15. The apparatus of claim 14 wherein the means for preventing comprises a resistor-capacitor combination coupled to the output terminals of the comparators.

16. A method of detecting theft of an electronic unit which sends and/or receives signal current, which signal current is generated by or in response to a power supply within or without the unit, the method comprising the steps of:

sensing an interruption of the signal current;

producing alarm status and equipment configuration information relating to the electronic unit whenever the signal current is interrupted for a period of time greater than a predetermined time period accessing a database, using at least a portion of the alarm status and configuration information as a retrieval key, to obtain reporting information; and providing a report.

* * * * *